US007942706B1

(12) United States Patent
McSweyn et al.

(10) Patent No.: US 7,942,706 B1
(45) Date of Patent: May 17, 2011

(54) CONFIGURABLE POWER DISTRIBUTION BLOCK

(75) Inventors: Christopher Michael McSweyn, Venice, CA (US); Kevin Trejo, Oak Hills, CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

(21) Appl. No.: 12/618,657

(22) Filed: Nov. 13, 2009

(51) Int. Cl.
*H01R 9/22* (2006.01)

(52) U.S. Cl. ..... 439/709; 439/798

(58) Field of Classification Search ..... 439/709, 439/798, 620.27, 620.26, 620.28, 620.29; 337/215, 227, 186
See application file for complete search history.

(56) References Cited

U.S. PATENT DOCUMENTS 5,167,541 A * 12/1992 Alves et al. ..... 439/620.29
5,328,392 A * 7/1994 Lin et al. ..... 439/833
5,551,894 A * 9/1996 Lin et al. ..... 439/620.27
5,618,209 A * 4/1997 Lin et al. ..... 439/620.26
6,162,097 A * 12/2000 Liang ..... 439/620.27
6,551,141 B2 * 4/2003 Liang ..... 439/620.27
6,753,754 B1 * 6/2004 Black et al. ..... 337/215
6,764,356 B2 * 7/2004 Becher et al. ..... 439/835
7,118,400 B1 * 10/2006 Lopez et al. ..... 439/170
7,234,968 B2 * 6/2007 Lottmann et al. ..... 439/620.01
7,452,240 B2 * 11/2008 Carter ..... 439/620.27
2009/0039706 A1 * 2/2009 Kotlyar et al. ..... 307/64

* cited by examiner

*Primary Examiner* — Hae Moon Hyeon
(74) *Attorney, Agent, or Firm* — Arent Fox LLP

(57) ABSTRACT

A configurable distribution block assembly includes a base member, a plurality of input terminals mounted to the base assembly, a plurality of output terminals mounted to the base assembly, and an insert, wherein the insert serves as an electrical bridge between at least two of the plurality of input terminals when the distribution block assembly is configured as the distribution block and the insert prohibits an electrical bridge between each of the plurality of input terminals when the distribution block assembly is configured as the power-ground combination block. In another aspect of the invention, a power distribution system includes a power source, a primary power wire, a primary ground wire, a distribution block assembly electrically connected to the power source by the primary power wire and the primary ground wire, and a plurality of electronic components electrically connected to the distribution block assembly.

18 Claims, 8 Drawing Sheets

CONFIGURABLE POWER DISTRIBUTION BLOCK

BACKGROUND

1. Field

The present disclosure relates to a distribution block assembly, and more particularly, to a configurable distribution block assembly that may be configured as a distribution block or a power-ground combination block.

2. Description of Related Art

Power distribution blocks are used to distribute power from a single power source to multiple electronic components. For example, in high fidelity car audio systems, a single battery cable may connect a distribution block to the main power source, a car battery. A conventional distribution block separates the current from the single battery feed into various outputs to power a number of separate components, such as audio amplifiers, for example. The distribution block ensures a clean, efficient method for supplying the required power to the multiple components without the need to couple each component individually to the power source. The distribution block may thus be mounted in an area of the vehicle, for example, that allows one cable to run from the power source, which is usually in a cramped, confined engine compartment, to an easily accessible area from where the output wires may be run to the various component areas without the difficulties associated with individually wiring each component directly to the power source.

In a similar fashion, the return ground cables from a variety of electronic components may be coupled through a distribution block, for example, to a single ground cable that completes the circuit to a battery ground terminal, for example.

There exists a need for one assembly that can easily and efficiently be configured to serve the function of a conventional power distribution block, a ground return block, and/or a combination of a power distribution block and a ground return.

SUMMARY

In one aspect of the disclosure, a configurable distribution block assembly can be configured to be one of a distribution block and a power-ground combination block. The configurable distribution block assembly includes a base member, a plurality of input terminals mounted to the base assembly, a plurality of output terminals mounted to the base member, and an insert, wherein the insert serves as an electrical bridge between at least two of the plurality of input terminals when the distribution block assembly is configured as the distribution block and the insert prohibits an electrical bridge between each of the plurality of input terminals when the distribution block assembly is configured as the power-ground combination block.

Another feature in accordance with aspects of the disclosure includes providing a conductive bridge between at least one of the plurality of input terminals and at least one of the plurality of output terminals. The conductive bridge may be a fuse, for example.

In another aspect of the disclosure, the plurality of input terminals comprises a left input terminal and a right input terminal, wherein the left and right input terminals each comprise an input socket housing portion and a distribution bar connected to the input socket housing portion. The left and right input terminals may further comprise a contoured shelf, and the insert may comprise an upper mating flange, wherein the contoured shelves of the left and right input terminals seat the upper mating flange of the insert. An upper surface of at least one of the left and right contoured shelves may have an insert fastening aperture and the upper mating flange of the insert may have a fastening through-hole, wherein the insert fastening aperture and the fastening through-hole concentrically align when the upper mating flange abuts the left and right contoured shelves. An insert fastener may extend through the fastening through-hole into the insert fastening aperture to removably couple the insert to at least one of the left and right input terminals.

In yet another aspect of the disclosure, the insert of the distribution block assembly may include a distribution socket when the distribution block assembly is configured as the power-ground combination block.

In another aspect of the disclosure, a power distribution system includes a power source, a primary power wire, a primary ground wire, a distribution block assembly electrically connected to the power source by the primary power wire and the primary ground wire, and a plurality of electronic components electrically connected to the distribution block assembly, each of the plurality of electronic components having a power wire and a ground wire electrically coupled to the distribution block assembly.

Another aspect of the disclosure in accordance with the present invention includes a method of completing an electrical circuit between a component and a power source that includes coupling a configurable distribution block assembly to the power source, coupling a component to the configurable distribution block assembly, and configuring the distribution block assembly as a distribution block or a power-ground combination block.

It is understood that other aspects of a distribution block assembly will become readily apparent to those skilled in the art from the following detailed description, wherein it is shown and described only exemplary configurations of a distribution block. As will be realized, the invention includes other and different aspects of a distribution block assembly and the various details presented throughout this disclosure are capable of modification in various other respects, all without departing from the spirit and scope of the invention. Accordingly, the drawings and the detailed description are to be regarded as illustrative in nature and not as restrictive.

DETAILED DESCRIPTION

Figure 1:
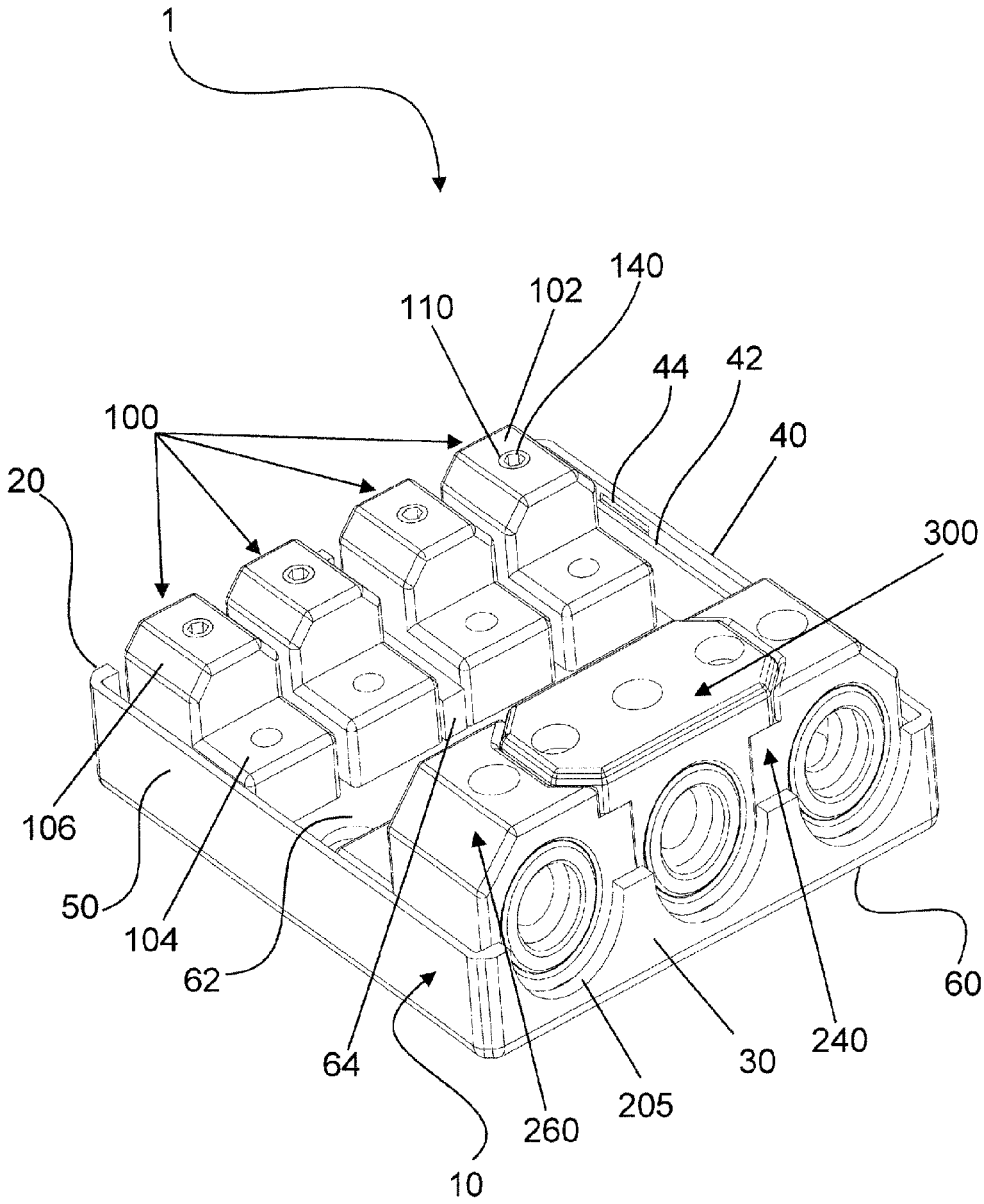
FIG. 1 is a perspective view of a distribution block assembly, in accordance with aspects of the present invention.

The present invention is described more fully hereinafter with reference to the accompanying drawings, in which various aspects of a distribution block assembly are shown. This invention, however, may be embodied in many different forms and should not be construed as limited by the various aspects of the distribution block assembly presented herein. The detailed description of the distribution block assembly is provided below so that this disclosure will be thorough and complete, and will fully convey the scope of the present invention to those skilled in the art.

The detailed description may include specific details for illustrating various aspects of a distribution block assembly. However, it will be apparent to those skilled in the art that the invention may be practiced without these specific details. In some instances, well known elements may be shown in block diagram form, or omitted, to avoid obscuring the inventive concepts presented throughout this disclosure.

Various aspects of a distribution block assembly may be illustrated by describing components that are coupled together. As used herein, the term "coupled" is used to indicate either a direct connection between two components or, where appropriate, an indirect connection to one another through intervening or intermediate components. In contrast, when a component referred to as being "directly coupled" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of an apparatus in addition to the orientation depicted in the drawings. By way of example, if an apparatus in the drawings is turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a distribution block assembly may be illustrated with reference to one or more exemplary embodiments. As used herein, the term "exemplary" means "serving as an example, instance, or illustration," and should not necessarily be construed as preferred or advantageous over other embodiments of a distribution block assembly disclosed herein.

FIG. 1 is a perspective view of a distribution block assembly 1 in accordance with aspects of the present invention. The distribution block assembly 1 is compact, ergonomically designed for ease of use, and configurable as either a distribution block or a power-ground combination block. The distribution block assembly 1 includes a base member 10 for mounting multiple, various gauge block terminals, including at least one output terminal 100, a left input terminal 240 and a right input terminal 260. A configurable insert, which may be a distribution block terminal 300, as shown by way of illustration in FIGS. 1, 2, 5 and 6, or a combination block insert 400, as shown by way of illustration in FIGS. 7-9, may be interchangeably mounted between the left input terminal 240 and the right input terminal 260 depending on whether the distribution block assembly is to be configured as a distribution block or a power-ground combination block, respectively.

Figure 2:
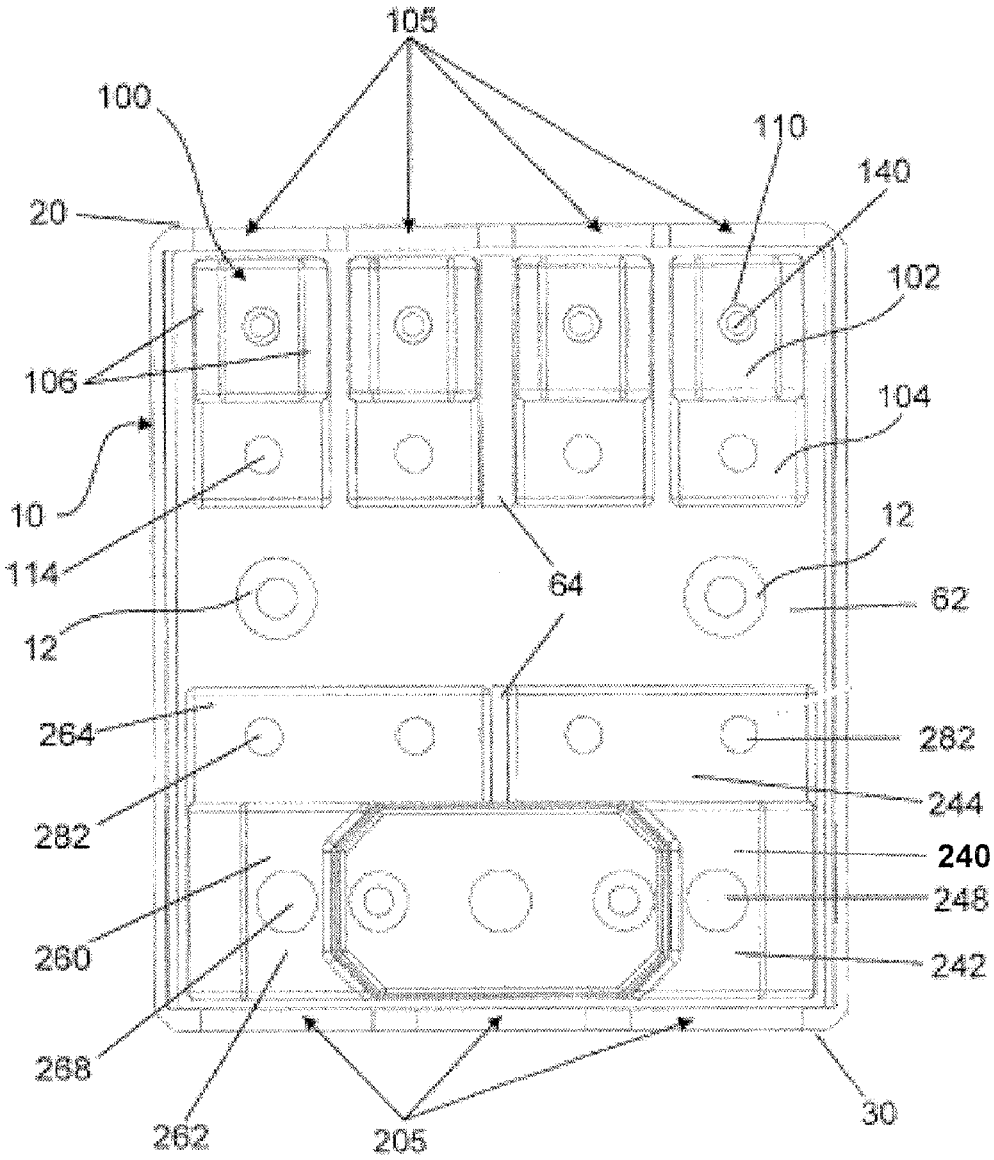
FIG. 2 is another top view of the distribution block assembly, in accordance aspects of the present invention.

As shown in FIGS. 1 and 2, the base member 10 may be generally rectangular in shape, for example, and may be formed from a non-conductive, impact resistant material, such as a polycarbonate or any suitable hard plastic. The base member 10 includes a rear wall 20, a front wall 30, a left wall 40, and a right wall 50 connected by a bottom plate 60. An impact resistant, polycarbonate protective cover (not shown) may be provided to mate with the base member 10 to enclose and protect the inner components of the distribution block assembly. The base member 10 may include means for securely attaching the protective cover. For example, as depicted in FIG. 1 with respect to the right wall 40, an inner ledge 42 may be formed to seat an extended edge (not shown) of the protective cover. The extended edge of the protective cover may include one or more tabs, for example, that slidably engage one or more slots 44 in the left wall 40 to secure the protective cover to the base member 10.

Figure 3:
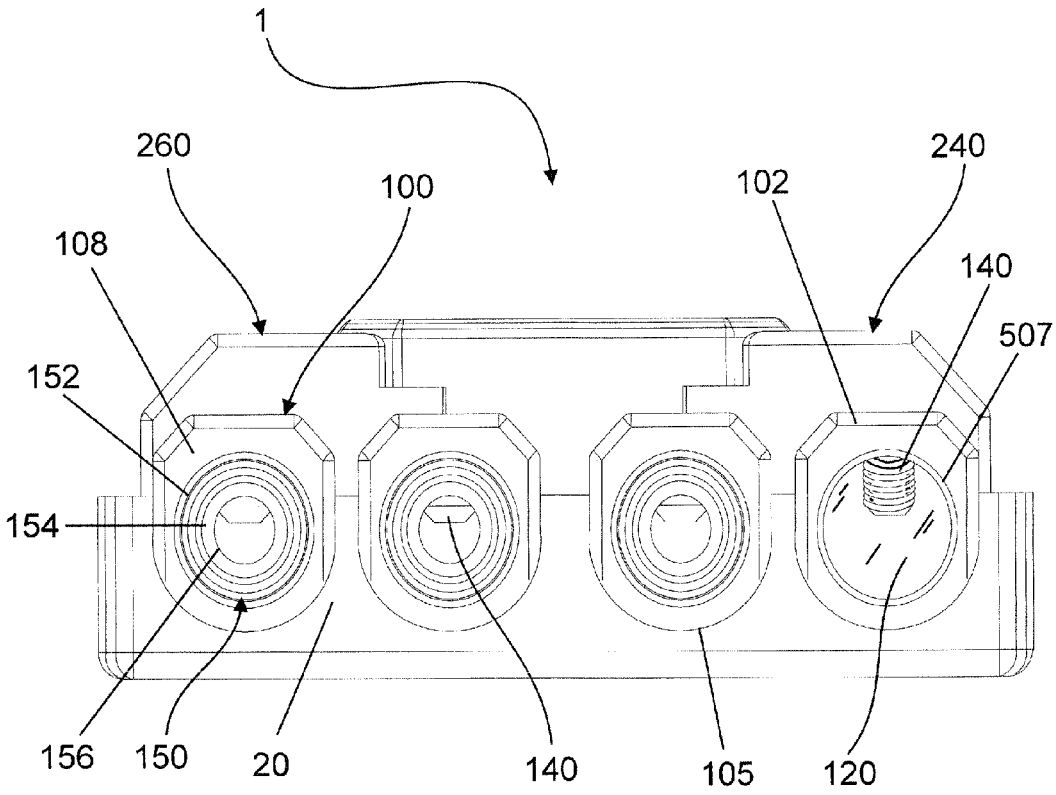
FIG. 3 is a rear view of the distribution block assembly, in accordance with aspects of the present invention.

As shown in FIGS. 1-3, the rear wall 20 and the front wall 30 of the base member 10 may be formed with a series of inverted arches, 105 and 205, respectively, to accommodate the insertion of a cable wire, for example, into any one of the respective terminals 100, 240, 250 and/or 300. Accordingly, the protective cover may have complementary mating arches (not shown) that, when the protective cover is seated and secured onto the base member 10, create circular insertion openings that allow the cable wire to pass through from an exterior of the distribution block assembly 1 into the various terminals 100, 240, 260, and/or 300. As shown in FIG. 2, the base member 10 may be formed with attachment orifices 12 in the bottom plate 60 for securely attaching the distribution block assembly 1 to a vehicle structural component, for example.

The output terminals 100 and the left and right input terminals, 240 and 260, may be fixedly attached to an upper surface 62 of the bottom plate 60. For example, the output terminals 100 and the left and right input terminals, 240 and 260, may be provided with internally threaded mounting holes (not shown) on a lower surface and fasten to the bottom plate 60 with threaded fasteners. To enhance the integrity of the electrical circuit and provide increased current flow through the components of the distribution block assembly 1, the output terminals 100 and the left and right input terminals, 240 and 260, may be forged from highly conductive material, including zinc or a zinc alloy such as brass, for example, and may also be plated with a suitable material such as nickel, brass or a chrome finish, for example, to provide corrosion resistance.

As shown in FIG. 1, each output terminal 100 may be formed in the manner of a stepped rectangular parallelepiped, having a taller socket housing portion 102 and a shorter stepped portion 104. The taller socket housing portion 102 may have beveled upper corner surfaces 106, for example, ergonomically designed to provide additional clearance and ease of assembly when, for example, placing and securing the protective cover to the base member 10. A socket connection portal 110 may be provided in an upper surface of the socket housing portion 102. The socket connection portal 110 provides access to an internal connection socket 120 (see FIG. 3), which may be a hollow cylindrical chamber, for example, extending into the socket portion 102 from an insertion end surface 108. The socket connection portal 110 may be internally threaded to mate with an externally threaded compression screw 140, for example, which may be a screw with a flat hex head. The externally threaded compression screw 140 may be screwed into the socket connection portal 110 so as to extend into the internal connection socket 120, as shown in FIG. 3. Accordingly, the internal connection socket 120 is formed to extend an appropriate longitudinal depth into the socket housing portion 102 from the insertion end surface 108 to provide access for the compression screw 140 when the compression screw 140 is inserted through the socket connection portal 110.

As shown in FIG. 3, the insertion end surface 108 of each output terminal 100 may have an easy insert profile 150 to guide insertion of an appropriate wire into the internal connection socket 120. The easy insert profile 150 may resemble a conical frustum having an outer opening 152 of larger diameter connected by a sloping surface 154 to an inner opening 156 of smaller diameter.

Figure 4:
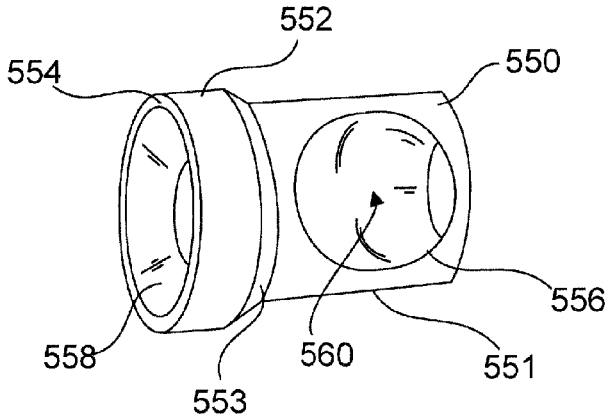
FIG. 4 is a perspective view of an insert to be used with the distribution block assembly, in accordance with aspects of the present invention.

In accordance with another aspect of the present invention, a separately formed insert 550, as shown in FIG. 4, may be formed to slidably fit into the internal connection socket 120, thus providing the capability to easily configure each output terminal 100 for different gauge wires. For example, an output terminal 100 with the insert 550 may accommodate a smaller 8 American Wire Gauge (AWG) wire, whereas an output terminal 100 with no insert 550, as depicted in the output terminal 100 on the right-hand side of FIG. 3, may permit connection of a larger wire, such as a 4 AWG wire, for example.

FIG. 4 illustrates that the insert 550 may be formed with a cylindrical main body 551, for example, and a cylindrical insert portion 552 joined through a sloped step region 553. The cylindrical insert portion 552 may have a greater outer diameter than an outer diameter of the cylindrical main body 551, and include a sloping surface 558 extending concentrically and longitudinally inward from a distal end 554 toward an insert connection socket 560. When the insert 550 is slidably inserted into the socket portion 102 of the output terminal 100, the stepped region 552 may abut a shelf 507 (see FIG. 3) that is provided a predetermined longitudinal distance into the socket housing portion 102 from the insertion end surface 108. The step region 553 may thus seat against the shelf 507 so that the distal end 554 of the insert 550 is flush with the insertion end surface 108 and an insert portal 556 may easily align with the socket connection portal 110. The insert portal 556 thus provides access to the insert connection socket 560 for the compression screw 140, for example, when the insert 550 is slidably inserted through the insertion end surface 108 and into the internal connection socket 120.

As shown in FIGS. 1 and 2, the distribution block assembly 1 may be assembled with four output terminals 100, for example, the four output terminals 100 being mounted laterally across a rear portion of the base member 10, wherein each output terminal 100 is physically separated from the other of the output terminals 100. Each output terminal 100 may be arranged with the insertion end surface 108 of the socket housing portion 102 facing an inner peripheral surface of the rear wall 20 so that the easy insert profile 150 and/or the insert 550 are centered with respect to the inverted arches 105. As shown in FIGS. 1 and 2, ribs 64 may extend from the upper surface 62 of the bottom plate 60 and provide a barrier between one or more of the output terminals 100, for example, and one or more of the other of the output terminals 100, as well as between the left and right input terminals 240 and 260. The ribs 64 provide a barrier between closely situated components to prevent short circuits and/or provide convenient positioning guides for mounting the various terminals during assembly. Although shown with ribs 64 extending longitudinally along a center line of the distribution block assembly 1, various ribs and/or positioning guides may be provided on the upper surface 62 and may be situated longitudinally and/or laterally with respect to the distribution block assembly 1.

Figure 5:
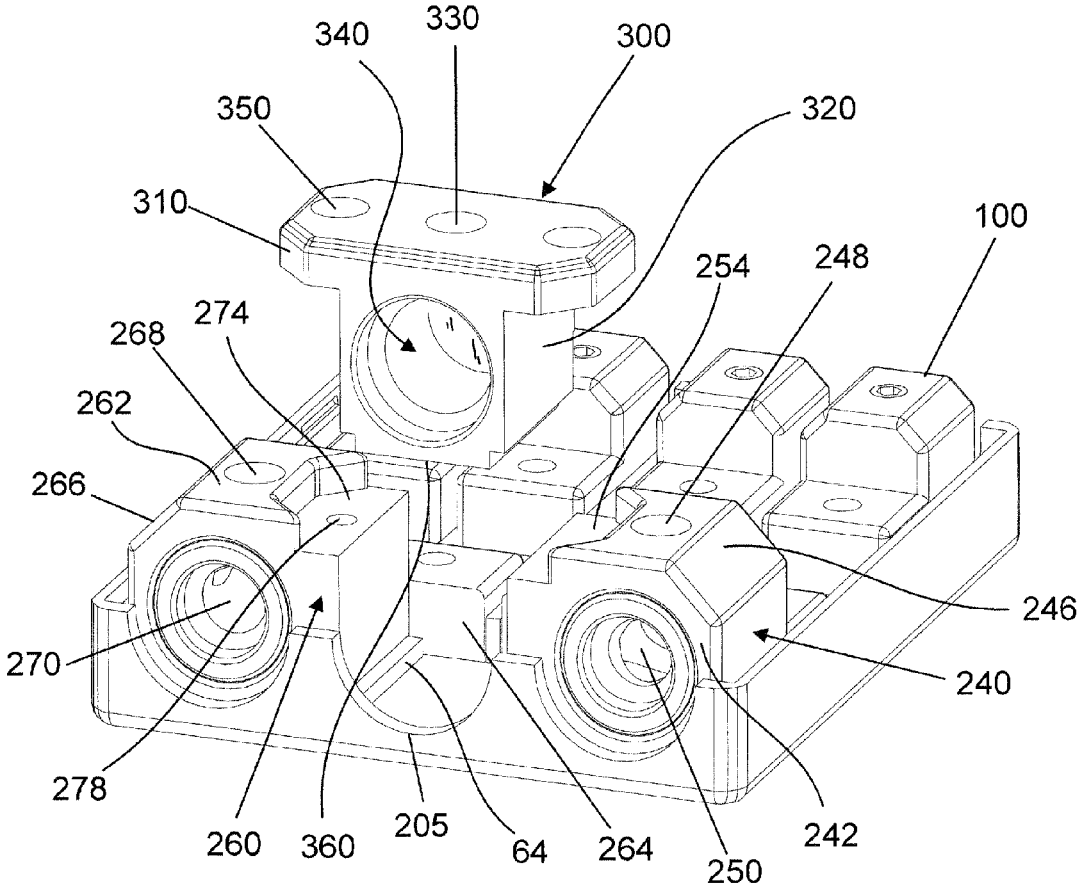
FIG. 5 is an exploded perspective view of the distribution block assembly, in accordance with aspects of the present invention.

As shown in FIGS. 2 and 5, the left and right input terminals, 240 and 260, may be formed to be mirror structures of each other. The left and right input terminals 240 and 260, respectively, may be formed with left and right input socket housing portions, 242 and 262, joined respectively to left and right transverse distribution bars, 244 and 264. The input socket housing portions 242 and 262 may have beveled upper corner surfaces, 246 and 266, for example, to provide additional clearance and ease of assembly when, for example, placing and securing the protective cover to the base member 10. Left and right input socket connection portals, 248 and 268, may be provided in respective upper surfaces of the input socket housing portions 242 and 262. The input socket connection portals 248 and 268 provide access to respective left and right input connection sockets 250 and 270 (see FIG. 6), which may be hollow cylindrical chambers, for example, extending into the input socket housing portions 242 and 262 from insertion end surfaces 252 and 272, respectively. The input socket connection portals 248 and 268 may be internally threaded to mate with externally threaded compression screws, for example, which may be a screw with a flat hex head. The externally threaded compression screws 280 may be screwed into the input socket connection portals 248 and 268, respectively, so as to extend into the input connection sockets 250 and 270, as shown with respect to the left input connection socket 250 in FIG. 6. Accordingly, the input connection sockets 250 and 270 are formed to extend an appropriate longitudinal depth into the input socket housing portions 242 and 262 from the insertion end surfaces 252 and 272 to provide access for the compression screws 280 when the compression screw 280 is inserted through the input socket connection portals 248 and 268.

Figure 6:
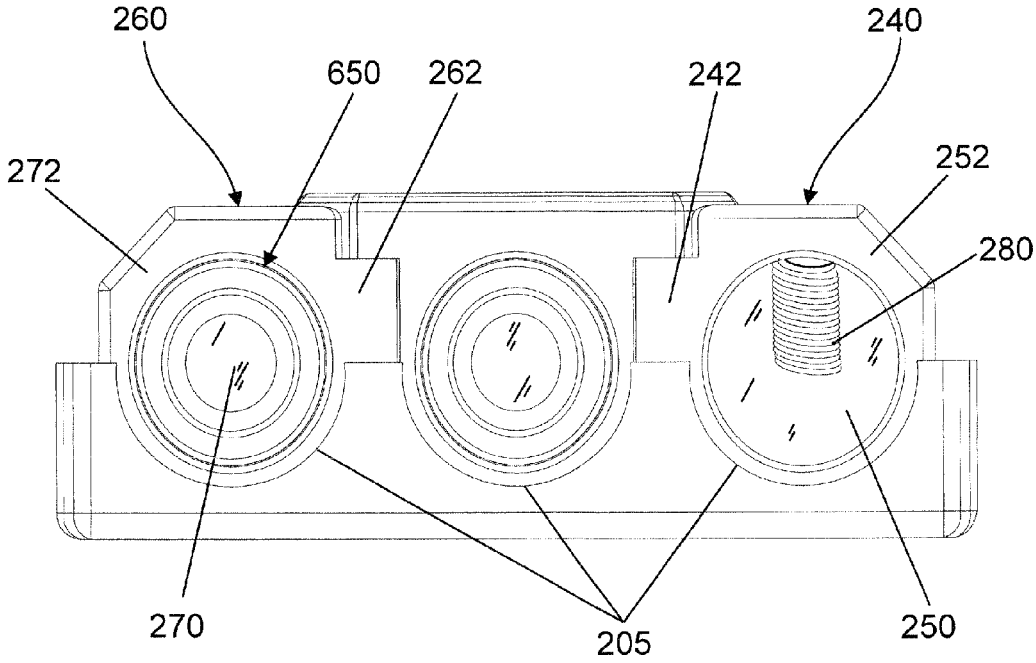
FIG. 6 is a front view of the distribution block assembly, in accordance with aspects of the present invention.

As shown in FIG. 6, the insertion end surfaces 252 and 272 of the left and right input terminals 240 and 260 may provide easy insert profiles 650 similar in structure to that of the easy insert profile 150 previously disclosed with respect to the output terminals 100, and as depicted in FIG. 3, and/or may employ the use of inserts (not shown) similar in structure to that of the insert 550 previously disclosed and depicted in FIG. 4, with the exception that the size of the components may be proportionally larger. For example, whereas the output terminals 100 may be configured to accept 4 and/or 8 AWG cable wires, the input terminals 240 and 260 may be configured to accept larger 0 and/or 4 AWG cable wires. As such, the structural features and associated description of easy insert profiles and/or inserts applicable to the left and right input terminals 240 and 260, respectively, are not repeated herein.

Figure 7:
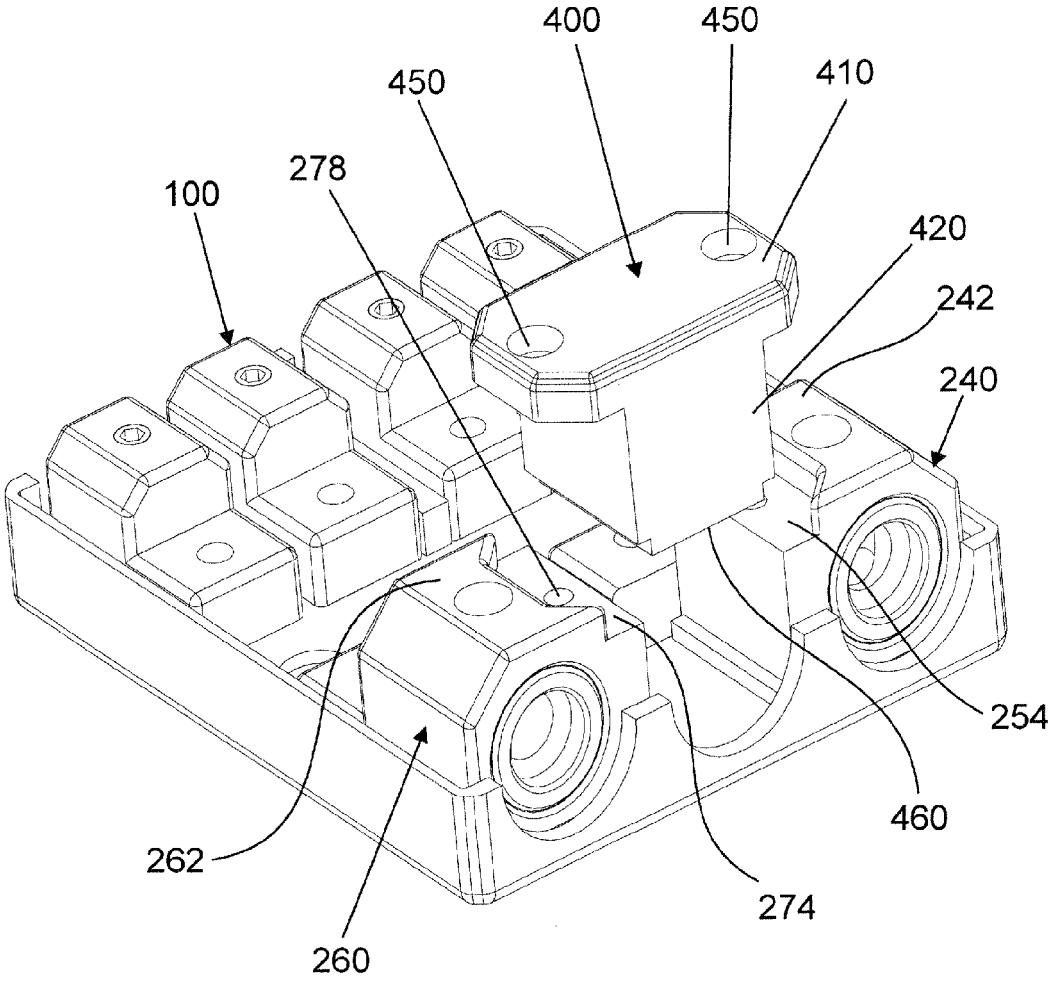
FIG. 7 is a another perspective view of the distribution block assembly, in accordance with aspects of the present invention.

As illustrated in FIGS. 5 and 7, the left and right input terminals 240 and 260 may each have a recessed shelf 254 and 274 provided in an upper surface of the input socket housing portions 242 and 262. The peripheral side walls of the recessed shelves 254 and 274 are contoured to match the peripheral contours of an upper mating flange 310 or 410 provided on the distribution block terminal 300 or the combination block insert 400, respectively. Depending on the configuration desired, the distribution block terminal 300 or the combination block insert 400 may be slidably positioned between the left and right input terminals 240 and 260.

In accordance with aspects of the present invention, the distribution block assembly 1 may be configured as a power distribution block by coupling the distribution block terminal 300 to the left and right input terminals 240 and 260, respectively. FIG. 5 shows the distribution block terminal 300 may include a distribution socket housing portion 320 that extends downward from a central portion of the upper mating flange 310. A distribution socket connection portal 330 may be provided that extends through a transverse center of the upper mating flange 310 and the distribution socket housing portion 320 to a distribution connection socket 340, which may be a hollow cylindrical chamber, for example. The distribution socket connection portal 330 may be internally threaded to mate with an externally threaded compression screw (not shown), for example, which may be a screw with a flat hex head. The externally threaded compression screw may be screwed into the distribution socket connection portal 330 so as to extend into the distribution connection socket 340. Fastening through-holes 350 may be provided near the peripheral contoured edges of the upper mating flange 310. The fastening through-holes 350 may have countersunk bearing surfaces and align with internally threaded fastening holes 278 provided in the recessed shelves 254 and 274 of the left and right input terminals 240 and 260, respectively.

The distribution block terminal 300 may be slidably positioned between the left and right input terminals 240 and 260 so that a lower surface 360 of the distribution socket housing portion 320 abuts the upper surface 62 of the bottom plate 60 and/or the contoured peripheral edges of the upper mating flange 310 are seated on the recessed shelves 254 and 274. Fasteners (not shown), such as hex bolts and/or hex head screws, may be used to couple the distribution block terminal 300 to the distribution block assembly 1 by extending through the fastening through-holes 350 and removably mating with the internally threaded fastening holes 278 in the left and right recessed shelves 254 and 274.

The distribution block terminal 300 may be formed with an easy insert profile similar in structure to that of the easy insert profile 150 previously disclosed with respect to the output terminals 100, and as depicted in FIG. 3, and/or may employ the use of a separate insert (not shown) similar in structure to that of the insert 550 previously disclosed and depicted in FIG. 4, with the exception that the size of the components may be proportionally larger. For example, whereas the output terminals 100 may be configured to accept 4 and/or 8 AWG cable wires, the distribution block terminal 300 may be configured to accept larger 0 and/or 4 AWG cable wires. As such, the structural features and associated description of easy insert profiles and/or inserts applicable to the distribution block terminal 300, respectively, are not repeated herein.

A primary power cable (not shown), such as a battery cable running from a car battery, may be connected to the distribution block assembly 1 by inserting the primary power cable into the distribution connection socket 340, and securing the primary power cable to the distribution block terminal 300 using a compression screw, for example. Tightening the compression screw extends the compression screw into the distribution socket connection portal 330, compressing the primary power cable against an internal surface of the distribution block terminal 300. The distribution block terminal 300 is formed from a highly conductive material, such as zinc or a zinc alloy such as brass, for example, and may be plated to provide corrosion resistance, such as with nickel or copper. Because of the conductive nature of the distribution block terminal 300, a current pathway may be established from the primary power cable to the distribution block terminal 300 and into each of the left and right input terminals 240 and 260. Thus, the current supplied by the primary power cable may be bridged to any or all of the output terminals 100 by completing a connection from the left and right distribution bars 244 and 264, respectively, to the output terminals 100. For example, a compact fuse, such as an AFC type fuse, may be used to complete the bridge between the left and right distribution bars, 244 and 264, and the output terminals 100. The fuse may provide additional protection in a system using high amperage components, such as high fidelity amplifiers used in some car audio systems.

Accordingly, as shown in FIG. 2, the distribution bars 244 and 264 are each formed with input terminal contacts 282. The input terminal contacts 282 may be screws, for example, that extend into internally threaded holes provided in the distribution bars 244 and 264. Each one of the input terminal contacts 282 may be formed to correspond to an output terminal contact 114 on one of the output terminals 100. The output terminal contacts 114 may be screws, for example, that extend into internally threaded holes provided in the lower stepped portion 104 of the output terminal 100. For example, as shown in FIG. 2, each of the left and right distribution bars 244 and 264 are provided with two input terminal contacts 282 which align longitudinally with one of the output terminal contacts 114 on each of the output terminals 100. Thus, the current received by the distribution block assembly 1 by way of the primary power cable may be distributed to supply power to multiple components by connecting one or more fuses, for example, from any or all of the output terminal contacts 282 to any or all of the corresponding input terminal contacts 114.

With the primary power cable thus connected, and an electrical bridge established between the left and/or right input terminal 240 and 260 and a plurality of the output terminals 100, the power supply may be effectively distributed by connecting power cables from the active output terminals 100 to the various components requiring power. Component power cables (not shown), for example, may be connected to the distribution block assembly 1 by inserting the component power cables into the internal connection socket 120 of an active output terminal 100 (i.e., one having an established electrical connection to the primary power cable). The component power cables are secured to the output terminals 100 using the compression screws 140, for example. Tightening, by using a hex key, for example, extends the compression screw 140 into the internal socket connection portal 110, compressing the component power cable against an internal surface of the output terminal 100. The conductive nature of the output terminal 100 completes the current path from the primary power cable to the distributed component power cables.

In accordance with aspects of the present invention, the distribution block assembly 1 may be configured as a power-ground combination block by coupling the combination block insert 400 to the left and right input terminals 240 and 260, respectively. As shown in FIG. 7, the combination block insert 400 may include a combination body portion 420 that extends downward from a central portion of the upper mating flange 410. Fastening through-holes 450 may be provided near the peripheral contoured edges of the upper mating flange 410. The fastening through-holes 450 may have countersunk bearing surfaces and align with the internally threaded fastening holes 278 provided in each of the recessed shelves 254 and 274 of the left and right input terminals 240 and 260, respectively.

The combination block insert 400 may be slidably positioned between the left and right input terminals 240 and 260 so that a lower surface 460 of the combination body portion 420 abuts the upper surface 62 of the bottom plate 60 and/or the contoured peripheral edges of the upper mating flange 410 are seated on the recessed shelves 254 and 274. Fasteners (not shown), such as hex bolts and/or hex head screws, may be used to couple the combination block insert 400 to the distribution block assembly 1 by extending through the fastening through-holes 450 and removably mating with the internally threaded fastening holes 278 in each of the left and right recessed shelves 254 and 274.

Figure 8:
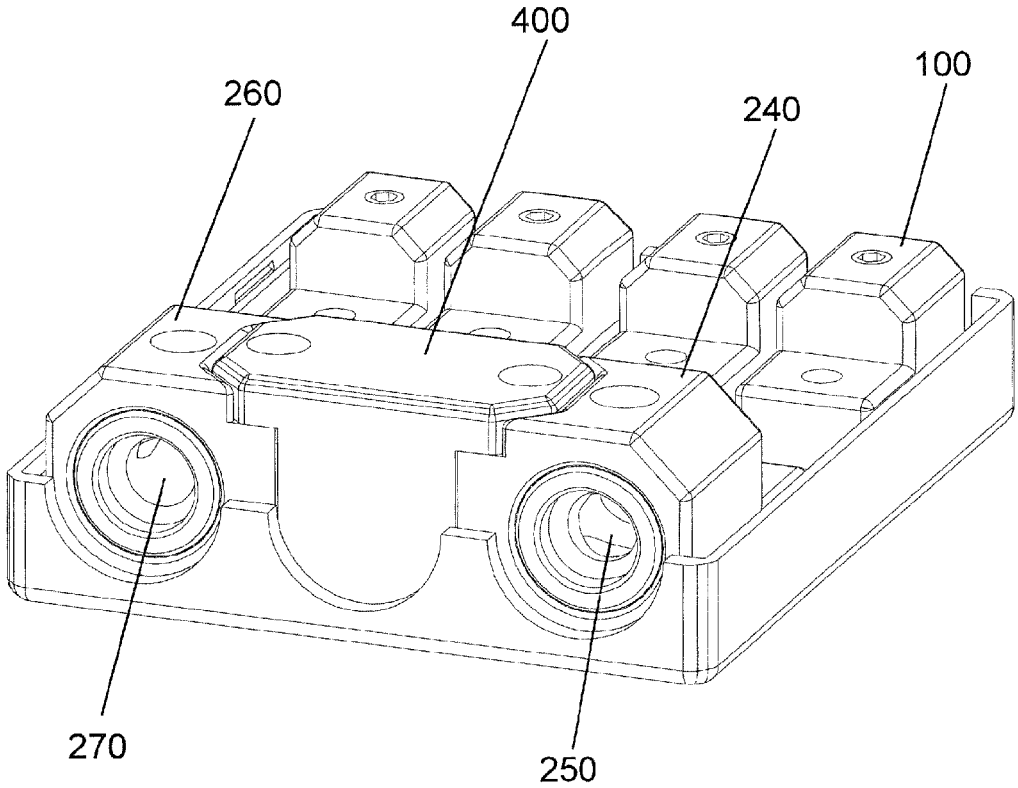
FIG. 8 is yet another perspective view of the distribution block assembly, in accordance with aspects of the present invention.

The combination block insert 400 is formed from a suitable non-conductive material, such as a polycarbonate or other such hard plastic, for example. Because of the non-conductive nature of the combination block insert 400, and unlike the configuration using the distribution block terminal 300, a current pathway is prohibited from existing between the left input terminal 240 and the right input terminal 260. Thus, with the combination block insert 400 positioned as shown in FIG. 8, the distribution block assembly 1 may be used to simultaneously distribute power to multiple electronic components through one of the left input terminal 240 or the right input terminal 260, while providing a means for consolidating the ground current through the other one of the left input terminal 240 or the right input terminal 260.

Figure 9:
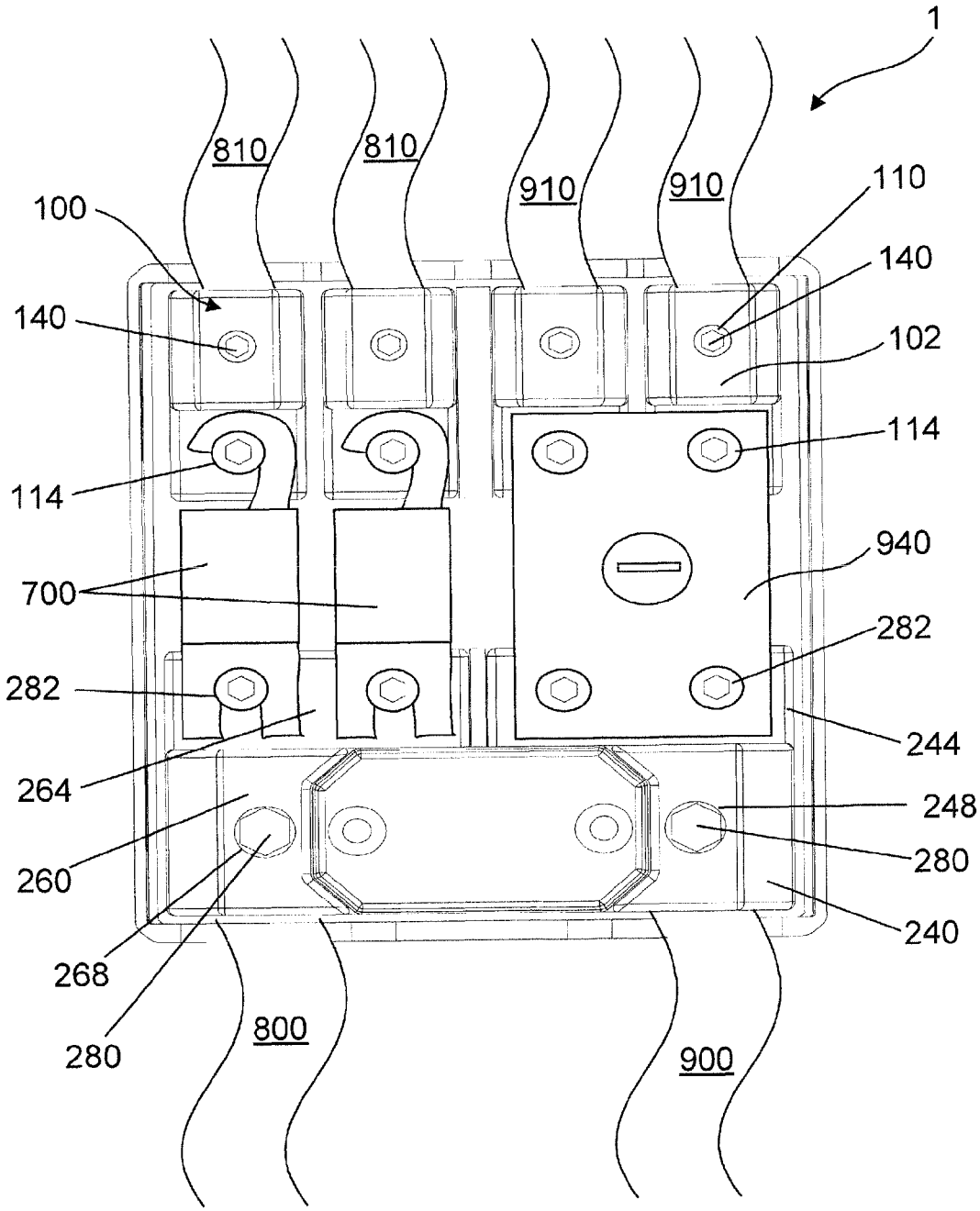
FIG. 9 is top view of the distribution block assembly configured as a power-ground combination block, in accordance with aspects of the present invention.

For example, as shown in the configuration depicted in FIG. 9, a primary power cable 800, such as a battery cable, may be connected to the right input terminal 260 by inserting the primary power cable into the right input connection socket 270, and electrically securing the primary power cable to the left input terminal 260 using a compression screw 280, for example. Tightening the compression screw 280 extends the compression screw 280 into the left input socket connection portal 268, compressing the primary power cable against an internal surface of the left input terminal 260. The current supplied by the primary power cable may thus be bridged to the two corresponding output terminals 100 by completing a connection from the right distribution bar 264 using compact fuses 700, for example, such as an AFC type fuse. The fuses 700 are each secured on one end to the right distribution bar 264 by the input terminal contact 282 and on the opposite end to the lower stepped portion 104 of the output terminal 100 by the output terminal contacts 114 on each of the output terminals 100.

As shown in FIG. 9, component power cables 810, for example, may be connected to the distribution block assembly 1 by inserting the component power cables 810 into the internal connection socket 120 of an activated output terminal 100 (i.e., one having an established conductive path to the primary power cable 800). The component power cables 810 are secured to the output terminals 100 using the compression screws 140, for example. Tightening, such as by using a hex key, extends the compression screw 140 into the internal socket connection portal 110, compressing the component power cable 810 against an internal surface of the output terminal 100. The conductive nature of the output terminals 100 completes the current pathway from the primary power cable 800 to the distributed component power cables 810.

As shown in FIG. 9 with respect to component ground cables 910, the ground cables 910 returning from the various electronic components may be connected to the two output terminals 100 corresponding to the left input terminal 240. A conductive ground plate 940, for example, may be used to provide an electrical bridge from the two output terminals 100 to the left distribution bar 244, completing a current pathway from the component ground cables 910 to the primary ground cable 900. The primary ground cable 900, which may be connected to the battery ground terminal (not shown), for example, may be electrically connected to the left input terminal 240 by being inserted into the left input connection socket 250 and secured with the compression screw 280.

The various aspects of this disclosure are provided to enable one of ordinary skill in the art to practice the present invention. Modifications to various aspects of a distribution block assembly presented throughout this disclosure will be readily apparent to those skilled in the art, and the concepts disclosed herein may be extended to other applications. Thus, the claims are not intended to be limited to the various aspects of a distribution block assembly presented throughout this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A configurable distribution block assembly that can be configured to be one of a distribution block and a power-ground combination block, comprising:

a base member;

a plurality of input terminals mounted to the base member;

a plurality of output terminals mounted to the base member; and an insert, wherein the insert serves as an electrical bridge between at least two of the plurality of input terminals when the distribution block assembly is configured as the distribution block; and wherein the insert prohibits an electrical bridge between each of the plurality of input terminals when the distribution block assembly is configured as the power-ground combination block.

2. The distribution block assembly of claim 1, further comprising a conductive bridge between at least one of the plurality of input terminals and at least one of the plurality of output terminals.

3. The distribution block assembly of claim 2, wherein the conductive bridge is a fuse.

4. The distribution block assembly of claim 1, further comprising a non-conductive rib extending from a surface of the base member, wherein the non-conductive rib serves as an electrical barrier between at least two of the input terminals.

5. The distribution block assembly of claim 1, wherein the plurality of input terminals comprises a left input terminal and a right input terminal, wherein the left and right input terminals each comprise an input socket housing portion and a distribution bar connected to the input socket housing portion.

6. The distribution block assembly of claim 5, wherein each of the left and right input terminals further comprise a contoured shelf, and the insert comprises an upper mating flange, wherein the contoured shelves of the left and right input terminals seat the upper mating flange of the insert.

7. The distribution block assembly of claim 6, wherein an upper surface of at least one of the left and right contoured shelves comprises an insert fastening aperture, and the upper mating flange of the insert comprises a fastening through-hole, and wherein the insert fastening aperture and the fastening through-hole concentrically align when the upper mating flange abuts the left and right contoured shelves.

8. The distribution block assembly of claim 7, further comprising an insert fastener, wherein the insert fastener extends through the fastening through-hole into the insert fastening aperture to removably couple the insert to at least one of the left and right input terminals.

9. The distribution block assembly of claim 1, wherein the output terminal comprises a connection socket for receiving an electrical wire.

10. The distribution block assembly of claim 9, further comprising an insert slidably mounted into the connection socket, wherein the insert reduces a size of the connection socket for receiving the electrical wire.

11. The distribution block assembly of claim 9, further comprising a compression screw, wherein the compression screw extends into the connection socket for securing the electrical wire to the distribution block assembly.

12. The distribution block assembly of claim 1, further comprising a protective cover, wherein the protective cover removably couples to the base member.

13. The distribution block assembly of claim 1, wherein the insert further comprises a distribution socket when the distribution block assembly is configured as the power-ground combination block.

14. A power distribution system, comprising:

a power source;

a primary power wire coupled the power source;

a primary ground wire coupled to the power source;

a distribution block assembly electrically coupled to the power source by the primary power wire and the primary ground wire;

a plurality of electronic components electrically coupled to the distribution block assembly, wherein each of the plurality of electronic components comprises a power wire and a ground wire electrically coupled to the distribution block assembly; and a configurable insert, input terminals comprises a left input terminal and a right input terminal and wherein the left and right input terminals are connected by the configurable insert.

15. The power distribution system of claim 14, wherein the distribution block assembly comprises:

a base member;

a plurality of input terminals mounted to the base member, wherein one of the plurality of input terminals is connected to the primary power wire and one of the other of the plurality of input terminals is connected to the primary ground wire.

16. A method of completing an electrical circuit between a component and a power source, comprising:

coupling a configurable distribution block assembly to the power source; and coupling a component to the configurable distribution block assembly, wherein the distribution block assembly includes:

a base member;

a plurality of input terminals mounted to the base member;

a plurality of output terminals mounted to the base member; and an insert mounted to the base member, wherein the insert serves as an electrical bridge between at least two of the plurality of input terminals when the distribution block assembly is configured as a distribution block; and wherein the insert prohibits an electrical bridge between each of the plurality of input terminals when the distribution block assembly is configured as a power-ground combination block.

17. The method of completing an electrical circuit between a component and a power source of claim 16, wherein the plurality of input terminals comprises two input terminals, and further comprising the step of:

configuring the distribution block assembly as the power-ground combination by connecting a power wire to one of the two input terminals and a ground wire to the other one of the two input terminals.

18. The method of completing an electrical circuit between a component and a power source of claim 16, wherein the insert comprises a distribution socket, and further comprising the step of:

configuring the distribution block assembly as the distribution block by connecting a power wire to the distribution socket.

* * * * *